US010018003B2

(12) United States Patent
Moore

(10) Patent No.: US 10,018,003 B2
(45) Date of Patent: Jul. 10, 2018

(54) MEANS FOR ACCOMMODATING CABLES IN TUBING ANCHORING TOOLS

(71) Applicant: Tazco Holdings Inc., Calgary (CA)

(72) Inventor: Edward Moore, Municipal District of Foothills (CA)

(73) Assignee: Tazco Holdings Inc., Calgary (CA)

( * ) Notice: Subject to any disclaimer, the term of this patent is extended or adjusted under 35 U.S.C. 154(b) by 0 days.

(21) Appl. No.: 15/684,069

(22) Filed: Aug. 23, 2017

(65) Prior Publication Data

US 2017/0350204 A1 Dec. 7, 2017

Related U.S. Application Data

(63) Continuation-in-part of application No. 14/705,846, filed on May 6, 2015, now Pat. No. 9,890,603.

(51) Int. Cl.

| | |
|---|---|
| ***E21B 23/01*** | (2006.01) |
| ***E21B 23/14*** | (2006.01) |
| ***E21B 17/02*** | (2006.01) |
| ***E21B 40/00*** | (2006.01) |
| ***E21B 43/10*** | (2006.01) |

(52) U.S. Cl.

CPC ..... *E21B 23/01* (2013.01); *E21B 17/023* (2013.01); *E21B 23/14* (2013.01); *E21B 40/00* (2013.01); *E21B 43/10* (2013.01)

(58) Field of Classification Search

CPC ..... E21B 23/01; E21B 17/023; E21B 23/14; E21B 40/00; E21B 43/10

See application file for complete search history.

(56) References Cited

U.S. PATENT DOCUMENTS

| | | | | |
|---|---|---|---|---|
| 4,787,446 | A | 11/1988 | Howell et al. | |
| 5,973,270 | A * | 10/1999 | Keller | E21B 17/1035 174/136 |
| 6,644,423 | B2 | 11/2003 | Bratton et al. | |
| 6,920,931 | B1 | 7/2005 | Webre et al. | |
| 2003/0075321 | A1 | 4/2003 | Hall | |
| 2015/0075769 | A1 * | 3/2015 | Abramova | E21B 28/00 166/65.1 |

FOREIGN PATENT DOCUMENTS

| | | | |
|---|---|---|---|
| EP | 0605071 | A1 | 12/1993 |

* cited by examiner

*Primary Examiner* — Yong-Suk Ro
(74) *Attorney, Agent, or Firm* — Field LLP

(57) ABSTRACT

A tubing anchoring tool connectable to a tubing string and positionable within a well conduit is provided, for preventing movement of a tubing string. The tool comprises one or more axial grooves formed along the length of an outer surface thereof, for accommodating cables placed therein.

4 Claims, 8 Drawing Sheets

MEANS FOR ACCOMMODATING CABLES IN TUBING ANCHORING TOOLS

FIELD OF THE INVENTION

The present invention relates to means for accommodating cables within and along tubing anchoring tools.

BACKGROUND

Tubing anchors are used for various purposes but mainly to hold strings of tubing in cased wellbores and more specifically to assist in maintaining tubing in tension. They are typically used in conjunction with well equipment particularly reciprocating rod pumps. The tubing anchor sets one or more slips against the well conduit usually well casing to grip the well conduit. The tubing may then be held in tension limiting its movement. Tubing anchor catchers perform these functions but also, should tubing string above the anchor catcher unthread or break the tubing anchor catcher provides a means to grip against the well conduit. For the purposes of the present invention these two general categories of tools are herein referred to collectively as "tubing anchoring tools".

As it is run into the well the tubing string often also has to carry different types of lines and cables downhole, including capillary lines and cables and other lines known to persons of skill in the art typically down to an intake section of the pump. For the purposes of the present invention such lines and cables can be referred to as "cable" or "cables". Once set, cable must remain positioned along the tubing string including running past tubing anchoring tools.

Running cables along such tubing strings past tubing anchoring tools may be difficult as there may be very little annular space between the tubing string and the wellbore casing. This is particularly true in casings with smaller inside diameters (ID's).

Furthermore, most prior art tubing anchoring tools often require multiple full (i.e. several 360 degree) rotations of the mandrel to either set or unset the tubing catcher. These are often called multi-rotation tools. Multi-rotation tools may either be threaded for multiple rotations, such as for example U.S. Pat. No. 3,077,933 to Bigelow, or may comprise a helical bearing track to provide multiple rotations, such as for example U.S. Pat. No. 5,771,969 to Garay. For purposes of the present invention such tools can be referred to as "multi-rotation anchoring tools".

In using multi-rotation anchoring tools where cable is installed in the well, extra cable has to be provided which cable is there to be used up in the setting of the multi-rotation tool (as the mandrel of the tool is rotated via rotating the tubing string from surface the extra cable becomes wrapped around the tubing string). Alternately the extra cable is originally pre-wrapped in an opposite direction to the direction of mandrel rotation and then when the tubing string and mandrel are rotated such extra cable unwinds leaving loose cable around the tubing string. In addition to the preceding difficulties with cable in using multi-rotation tools, multi-rotation tools are sometimes not preferred for narrow or deviated well conduits in which there is no room to accommodate multiple rotations of the tubing string to set or unset a tubing anchoring tool, and there are the additional, preceding concerns with the use of cables with multi-rotation anchoring tools.

More recently tubing anchor catchers and tubing anchors that are set by turning their mandrels only a portion of a full rotation preferably by only a quarter or one third rotation or turn of their mandrels, by means including a pin and slot arrangement within the drag body and mandrel respectively, have been invented and employed for this purpose. The only known such quarter turn anchoring tools are described in Applicant's Canadian application number 2,890,533 or US patent publication number 2015/0233199A1, or Applicant's Canadian application number 2,798,833. For the purposes of the present invention such tools can be referred to collectively as "quarter turn anchoring tools". The actuation of quarter turn anchoring tools obviously does away with certain of the challenges of multi-rotation anchoring tools that were described preceding.

Quarter turn anchoring tools (and multi-rotation anchoring tools) comprise a slip retainer or slip cage for housing slips to grip the well conduit. These slip cages are made of a single integral pipe or tube of metal with windows formed therein to accommodate the slips. Similarly, the drag bodies holding the drag blocks are also made from a separate, single integral piece of pipe or tubular metal.

As described in the preceding-mentioned patent applications and above, such quarter turn tubing anchoring tools are preferably used in wellbores where the annular space between the outside of the slip cage and drag block on the one hand, and the inside of the well conduit on the other, is small. Such space may be too small for usual cables to fit in between particularly slip cage outer diameters (OD's) and casing ID's. But such tools are not seemingly adaptable to accommodating a gap or break in the slip cage and drag body to locate a place for accommodating cable to be run past them, given the respective problems namely the slip cages and drag bodies are unitary in nature and should remain so to better enable them to withstand multiple significant forces particularly when the slips are actuated, and given the smaller spaces for such cable between slips and blocks.

Running cables inside of portions of tubing anchoring tools has been tried but has led to problems including the expected movement and function interference where cables come into contact with portions of slips drag blocks or other internal parts.

Therefore the need to accommodate running cable past tubing anchoring tools of both a multi-rotational anchoring tool kind, and in particular for quarter turn anchoring tools, still arises. For the purposes of the present invention such anchoring tools may be collectively referred to as "tubing anchoring tools".

SUMMARY

An improvement to tubing anchoring tools has been invented which provides a means for passing cable by a tubing anchoring tool. The tubing anchoring tool comprises a groove running axially along the slip cage and drag body portions, and along any other portions of any tubing anchoring tool which may provide a large outer diameter of the tool, into which cable may be placed.

Further, an improvement to a tubing anchor catcher type of tubing anchoring tool that is set by a quarter turn of its mandrel, preferably by a quarter or one third turn of its mandrel by means including a pin and slot arrangement within the drag body and mandrel respectively, along with such tool having a groove aforesaid for accommodating running cable past the tool, has been invented.

Still further, an improvement to a tubing anchor type of tubing anchoring tool that is set by a quarter turn of its mandrel, preferably by a quarter or one third turn of its mandrel, by means including a pin and slot arrangement with the drag body and mandrel respectively, along with such tool having a groove aforesaid for accommodating running cable past the tool, has been invented.

In a tubing anchoring tool connectable to a tubing string and positionable within a well conduit for preventing movement of a tubing string in both directions axially and radially, and the tool comprises one or more axial grooves formed along a length of an outer surface of the tool for accommodating cable placed therein.

Further, a tubing anchor catcher positionable within a well conduit is provided, for preventing movement of a tubing string. The tubing anchor catcher comprises a mandrel connectible within the tubing string, the mandrel comprising an externally facing slot; a slip cage slidably mountable about the mandrel, the slip cage comprising a slip or slips that are adapted for engaging an inner surface of the well conduit; a first cone element that is slidably mountable about the mandrel, adjacent the slip cage and comprising a first conical surface; a drag body slidably mountable about the mandrel, adjacent the slip cage, the drag body comprising a drag member sized for frictionally engaging an inner surface of the well conduit, a pin for engaging the externally facing slot, and a second conical surface; a biasing member slidably mountable about the mandrel adjacent the first cone element for engaging the first cone element when the biasing member is compressed; and one or more axial grooves formed on along the length of an outer surface of the drag body and the slip cage, for accommodating cable placed therein.

A tension tubing anchor for anchoring well equipment in a well conduit for maintaining tension. The tubing anchor comprises a mandrel connected to tubing or the well equipment; a cone element mounted to the mandrel and having a first conical surface; a drag body mounted on the mandrel, housing a drag means for contacting the well conduit, and having a second conical surface; a slip cage mounted on the mandrel adjacent to the drag body, housing a slip or slips, each of the slip or slips having an inner surface, and an opposed outer surface for gripping the well conduit, the slip or slips, or the slip cage comprising biasing means for urging the slip inwardly toward the mandrel and away from the well conduit; the drag body having at least one drive pin and a portion of the drive pin protruding toward the mandrel; the mandrel having at least one groove for each drive pin for slideably receiving the protruding portion of the drive pin; and one or more axial grooves formed on along the length of an outer surface of the drag body and the slip cage, for accommodating cable placed therein.

A multi-rotation tubing anchoring tool is further provided, connectable to a tubing string and positionable within a well conduit, for preventing movement of the tubing string, said tool comprising one or more slips that are set by multiple full rotations of a mandrel of the tool; and one or more axial grooves formed along a length of an outer surface of the tool for accommodating cable placed therein.

BRIEF DESCRIPTION OF THE DRAWING FIGURES

Embodiments of the disclosure will now be described, by way of example only, with reference to the accompanying drawings, wherein:

FIG. 1*a* is a side perspective side view of an example embodiment of a quarter turn tubing anchor catcher having an axial groove formed thereon;

FIG. 1*b* is a front end view of the tubing anchor catcher of FIG. 1*a;*

DESCRIPTION OF PREFERRED EMBODIMENTS

Figure 1B:
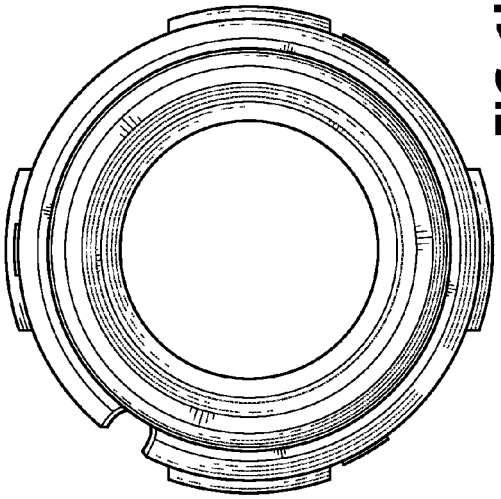

The present disclosure relates to a substantially axial groove 98 formed along the body of an anchor or anchor catcher tool 10 to accommodate cables that run through a wellbore. While more than one axial groove 98 can be formed, there is preferably one axial groove along the tubing anchoring tool.

For the purposes of the present invention, the terms 'substantially axially,' 'axially', 'substantially axial' and 'axial' are all understood to incorporate grooves that can be axial, diagonal, linear, curved, mildly S-shaped, or any combination thereof.

FIGS. 1 to 6 depict one example embodiment of a quarter turn tubing anchor catcher 10 having an axial groove 98. The tubing anchor catcher 10 may be inserted within a well conduit 12 (see FIG. 4), such as a wellbore casing. Details of one example of such a quarter turn tubing anchor catcher can be seen in Applicant's Canadian application number 2,890,533 or US patent publication number 2015/0233199A1.

Figure 7:
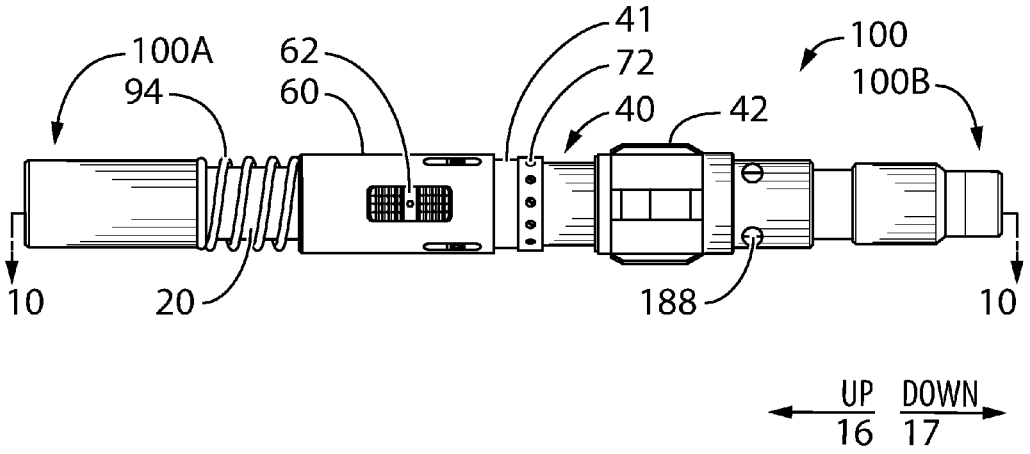
FIG. 7 is a side elevation view of a second embodiment tubing anchor catcher which can incorporate an axial groove of the present invention.
Figure 8:
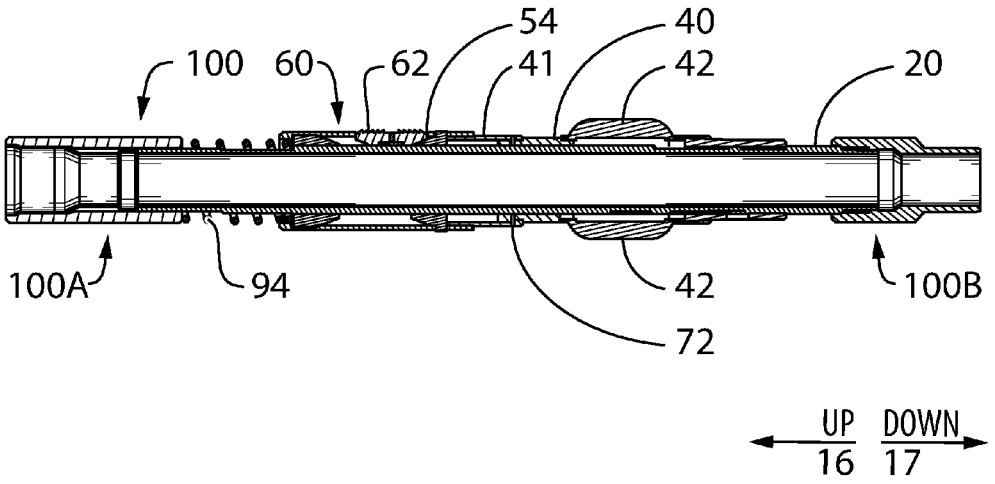
FIG. 8 is a mid-line, sectional view of the tubing anchor catcher of FIG. 7.

FIGS. 7 and 8 depict one example embodiment of a quarter turn tubing anchor in which the linear groove of the present invention could also be used. One example of such a quarter turn tubing anchor can be seen in Applicant's Canadian application number 2,798,833.

Generally, while the present invention may be applied for use in all tubing anchoring tools it is preferably used with any tubing anchor or anchor catcher that can be set and unset with none to minimal rotation. More preferably, the present invention can be used with any tubing anchor or anchor catcher that can be set and unset with between ¼ to just under a full rotation of the tool. Most preferably the rotation comprises from ¼ to ½ a turn of the tool. For the purposes of the present invention these ranges of rotation is herein referred to throughout as "quarter turn".

Specifically the present invention includes allowing cables to be accommodated along the tubing anchoring tool 10.

It is possible to incorporate the axial groove of the present invention in quarter turn anchoring tools and in multi-rotation tubing anchoring tools.

As with multi-rotational anchoring tools, in the case of quarter turn tubing anchoring tools such as those described in more detail below with reference to FIGS. 1-8, there is limited space between the slips and/or drag blocks. Each axial groove of the present invention is preferably formed by removing preferably one axial strip of material from each of the tubes that comprise the slip cage and the drag body, thus forming one or more narrow axial gaps in the slip cage and drag body. While more than one axial groove may be desirable and while further such gaps can be formed in different sections of the slip cage and drag block tubes, and while such is within the scope of the present invention, most applications will require a single axial groove. For convenience the description of constructing the axial groove will be described with reference to the alternative of having only a single groove.

A pipe or tube of reduced diameter, preferably made of the same metal the slip cage is made of, and preferably having an inside diameter to just accommodate placement of the cable within it (once axially halved), is installed preferably by being welded into place. The pipe may then be axially halved to provide a groove with a rounded (approximately 180 degrees) inner diameter. Alternately tubes already axially-halved may be attached to the narrow axial gaps formed in the slip cage and drag body. The inventors have found that in use such axial groove maintain sufficient strength of the slip cage and drag body while still providing a means of accommodating cables. Further that in practice an axial groove provides the correct depth to accommodate cable advantageously partway in the tool and partway between the tubing anchoring tool and ID of the casing. However it is noted that the formation of an axial groove by other means and the formation of a groove of another shape(s) of inner diameter (for example and without limiting the generality of the present invention it may be formed of a square "trough" versus a concave "trough" are all within the scope of the present invention.

Further the groove may be of another depth and may be larger than the diameter sufficient for fittingly placing cable within. Further, and as noted above, the groove may be other than linear in orientation, and for example and without limiting the generality of the present invention, the linear groove may be "s-shaped" instead of linear in orientation.

All such variations are, and any variation of a groove is, within the scope of the present invention.

The invention includes a novel quarter turn tubing anchor catcher with an axial groove.

An inventive tubing anchoring tool that is a quarter turn tubing anchor catcher which comprises a linear groove will now be described.

FIGS. 1 to 6 depict one example embodiment of a quarter turn tubing anchor catcher 10. The tubing anchor catcher 10 may be inserted within a well conduit 12 (see FIG. 4), such as a wellbore casing.

Figure 1A:
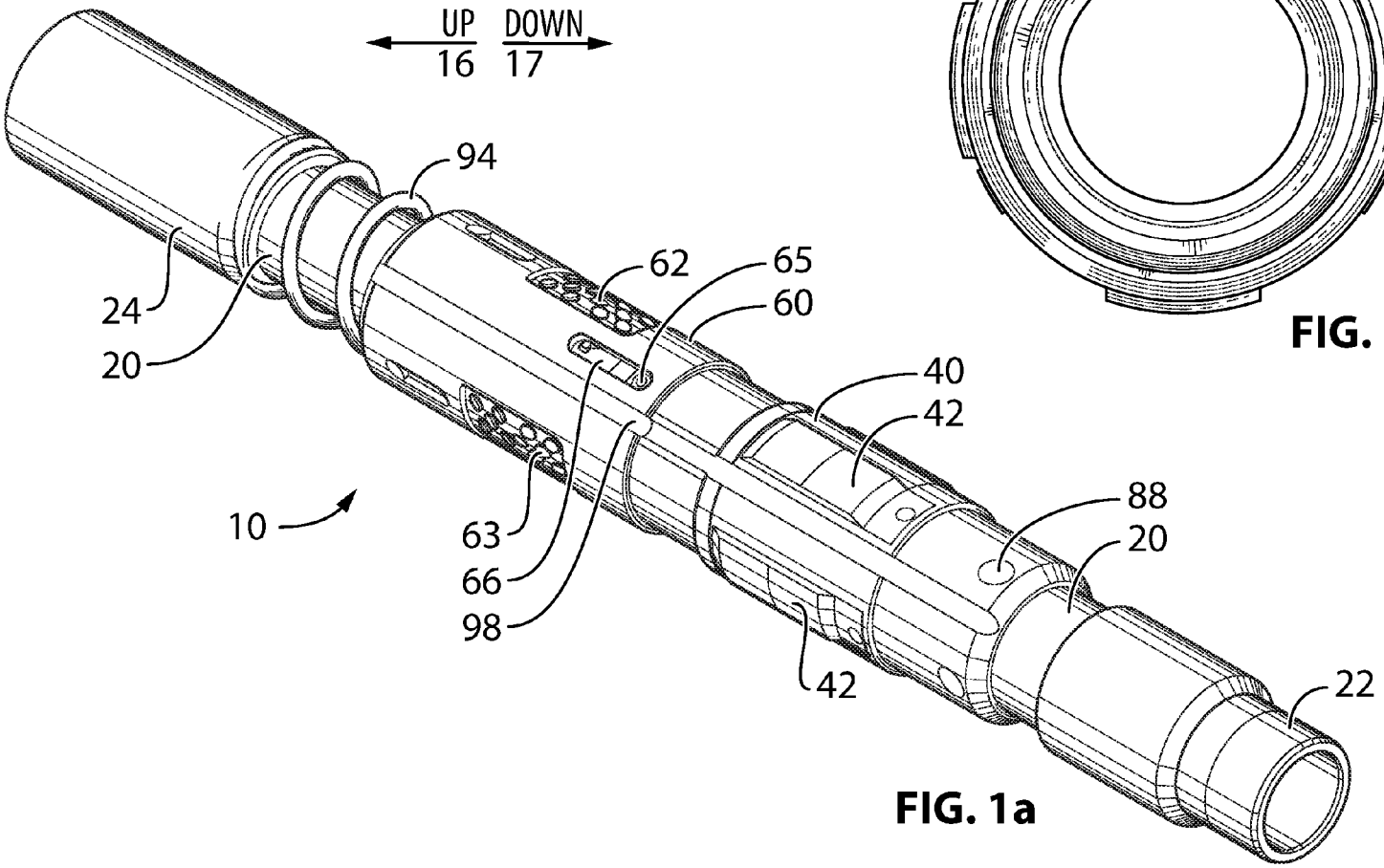
Figure 2:
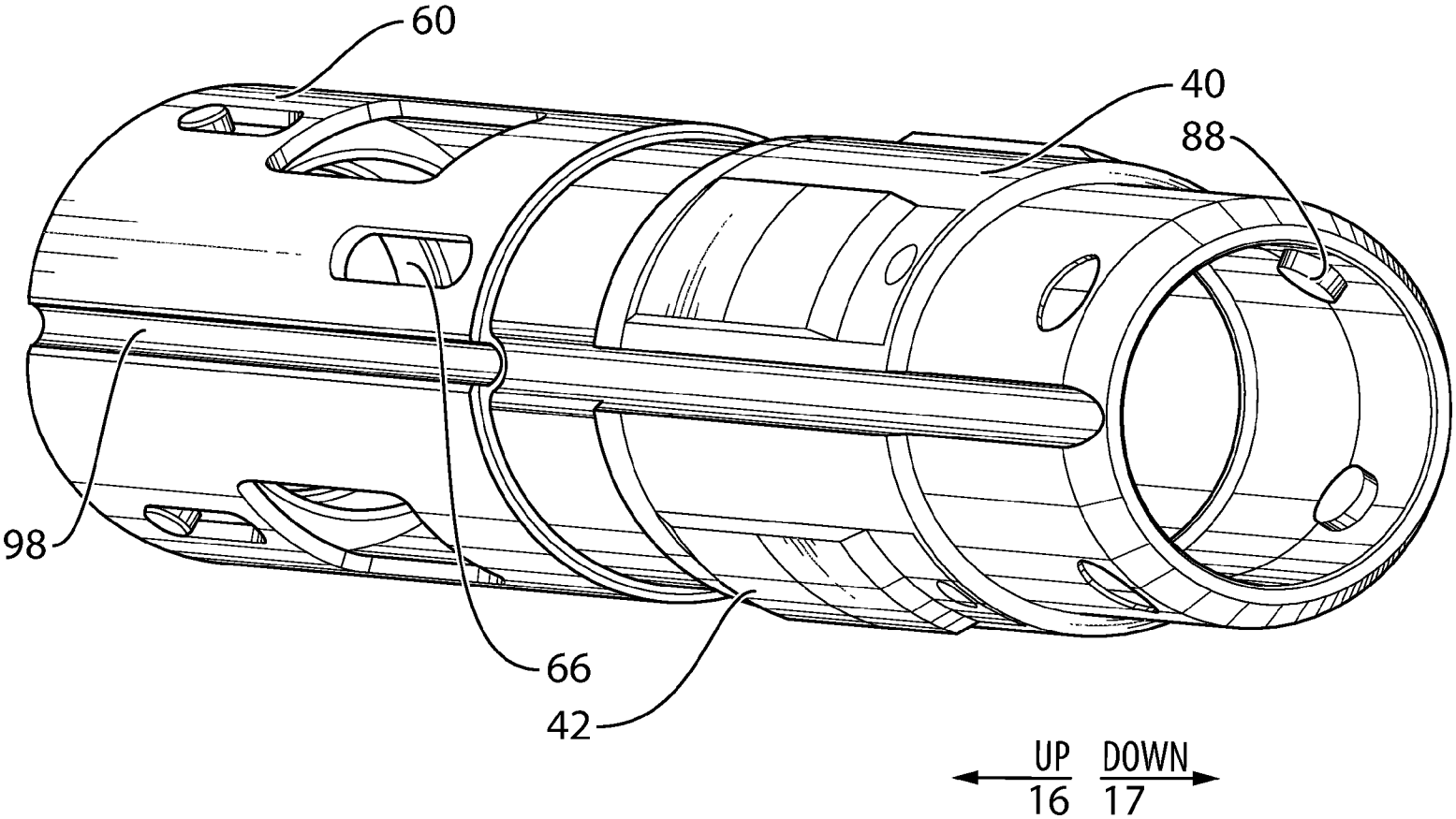
FIG. 2 is a detailed side perspective view of FIG. 1*a* showing one example of the slip cage and one example of the drag body with the groove formed thereon.
Figure 3:
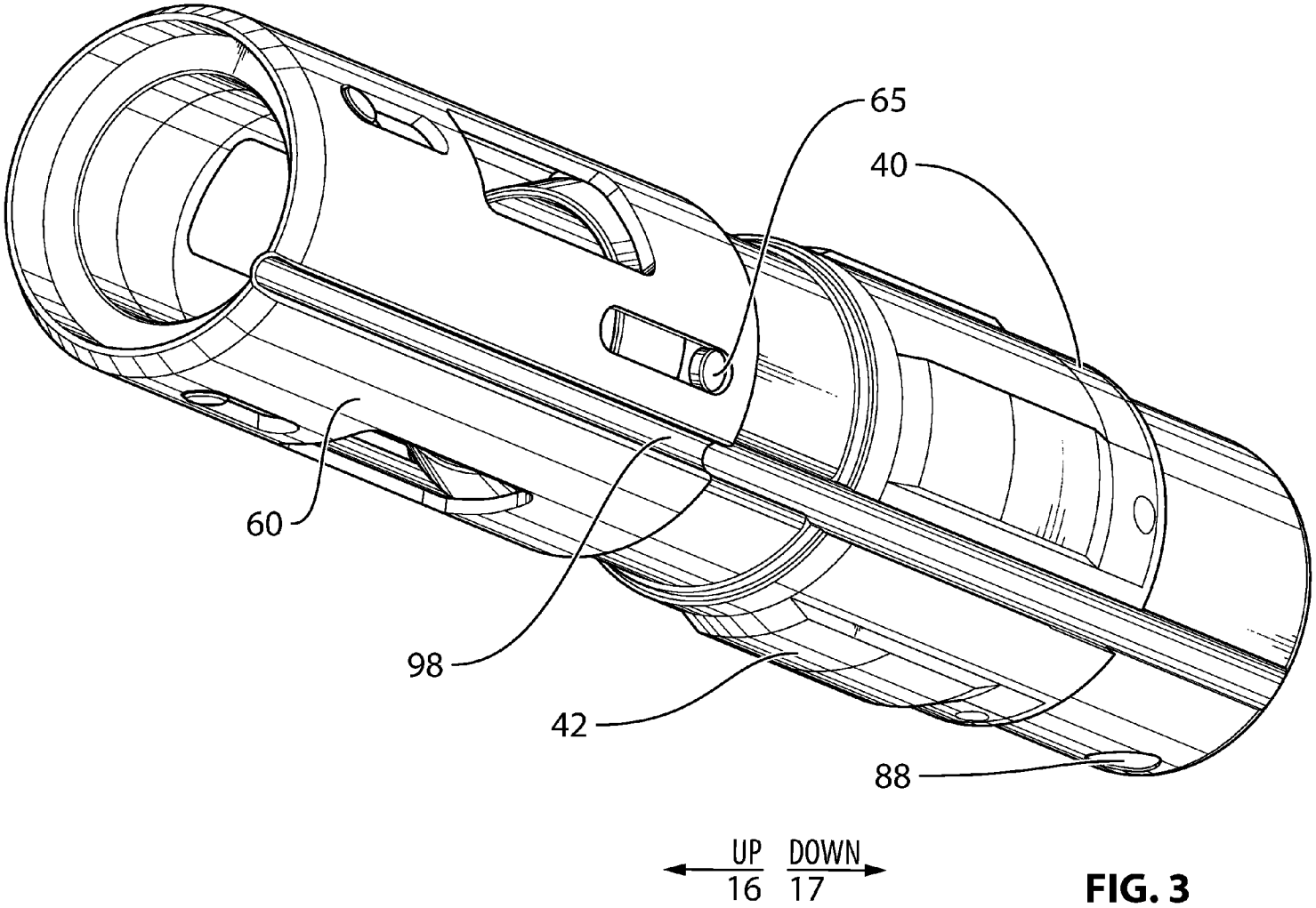
FIG. 3 is a detailed side perspective view of FIG. 1*a* showing one example of the slip cage and one example of the drag body with the groove formed thereon.
Figure 4:
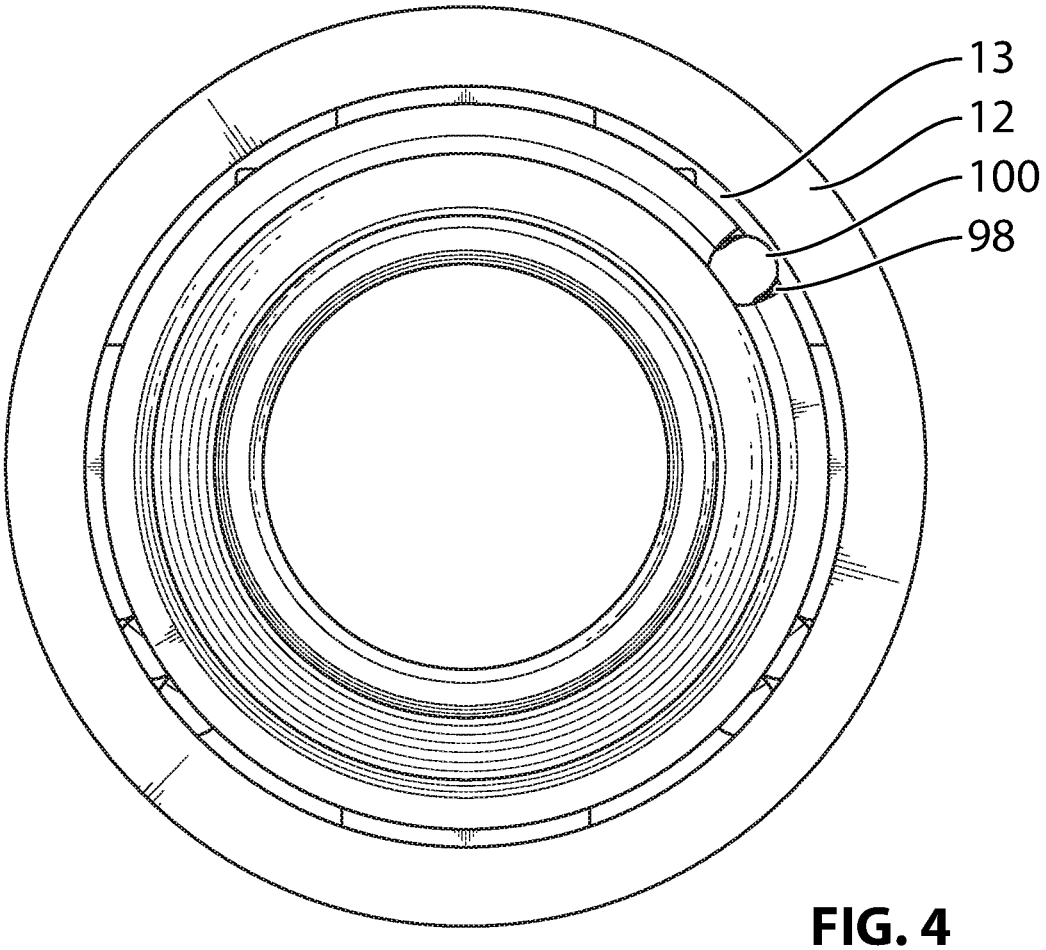
FIG. 4 is an end view of the tubing anchor catcher of FIG. 1*a*, in the set position, with a cable running in the axial groove.

FIG. 1 depicts the tubing anchor catcher 10 in an unset, or "run-in", orientation in which it can be run inside the well conduit 12, such as that shown in FIG. 4 on a tubing string. A mandrel 20 of the tubing anchor catcher 10 may include attachment means such as a threaded lower end 22 and a threaded upper end 24. In this embodiment, the tubing anchor catcher 10 may be threadedly connected within the tubing string and run down the well conduit 12 while being in the downhole direction indicated by arrow 17. Arrow 16 indicates the opposite direction within the well conduit 12, namely the uphole direction. It is noted, however, those terms such as "up", "uphole", "up hole", "down", "downhole", "down hole", "forward", "backward" and the like are used to identify certain features of the tubing anchor catcher 10 when placed in a well conduit. These terms are not intended to limit the tubing anchor catcher's use or orientation.

The tubing anchor catcher 10 may comprise of a drag body 40, a slip cage 60 and a biasing member 94, all of which are mounted about the external surface of the mandrel 20. The biasing member 94 can be for example, a coiled spring. The drag body 40 houses a drag means, in the form of one or more drag springs or drag blocks 42, for spacing the tubing anchor catcher 10 away from the inner wall 13 of the conduit 12. The drag blocks 42, for example three or four drag blocks 42, may be generally evenly spaced circumferentially about the tubing anchor catcher 10. Each drag block 42 has a drag spring 44 to urge the outer surface of the drag block 42 against the well conduit's inner wall 13. In addition to keeping the tubing anchor catcher 10 spaced from the well conduit 12, the contact of the outer surface of the drag block 42 to the well conduit's 12 inner wall or surface 13 causes friction that urges the drag body 40 to remain stationary while the mandrel 20 moves within the rest of the tubing anchor catcher 10.

The drag body 40 and the slip cage 60 both include a groove 98 extending axially along their outer surfaces, as seen in FIGS. 1-4. The axial groove 98 accommodates cables or capillary lines to be carried down hole. As seen in FIG. 4, the cable 100 can be fit in the axial groove 98. While only one groove 98 is shown in the Figures, it would be well understood by a person of skill in the art that more than one groove 98 can be present along the axial length of the drag body 40 and slip cage 60, for example, between any number of the drag blocks 42 and slips 62.

The axial groove 98 provides further advantage in that the cable 100 now sits flush with the outermost surface of the tool, as seen in FIG. 4, with little or no radial protrusion towards the well conduit, to ensure that it does not catch in any surface of the wellbore.

Furthermore, the axial groove 98 in the present anchor catcher allows for knowing the exact location of the cable 100 between the drag blocks 42, which provides an assurance that the cable 100 will not get caught against a drag block 42 when the drag blocks 42 engage with an inside diameter of the wellbore conduit 12. The present design further serves to accommodate cable in applications with narrow wellbore conduits that have very little annular space between the tubing string and the wellbore inside diameter.

As will be discussed further, the drag body 40 is connected to the mandrel 20 by one or more drive pins 88 that extend inwardly from the inner surface of the drag body 40 to engage a slot 80 that is formed on the outer surface of the mandrel 20. In one example embodiment, the drive pins 88 are made from a shearable material.

The slip cage 60 is mounted on the mandrel 20 adjacent the drag body 40, preferably above the drag body 40 (i.e. in direction 16). The slip cage 60 may house one or more movable slip or slips 62. For example, three slips 62 are depicted as being evenly spaced about the slip cage 60, although this is not intended to be limiting as the tubing anchor catcher 10 described herein may operate with one or more slips 62. Each slip or slips 62 have an outer surface with teeth 63 for gripping the inner wall 13 upon contact. The teeth 63 comprise upward gripping teeth 63B and downward gripping teeth 63A. One or more fasteners in the form of a cap pin or cap screw 65 is fastened to the drag body 40 and each is located within one of a plurality of associated elongate slots 66 that are defined by the slip cage 60 and spaced circumferentially thereabout, preferably between each slip or slips 62. The cap screw 65 is adapted to travel within associated slots 66 to permit movement of the slip cage 60 relative to the drag body 40 and to prevent the slip cage 60, and the drag body 40, from longitudinally separating.

An upper cone element 70 is mounted about the mandrel 20 at an upper end of the slip cage 60. The upper cone element 70 forms a first conical surface and an upper edge of the drag body 40 forms a second conical surface 54. The first and second conical surfaces 70, 54 do not actuate the slip or slips 62. A slip spring 76 urges each slip or slips 62 radially inwardly into the slip cage 60 and away from the well conduit 12 while in the unset position.

Figure 5:
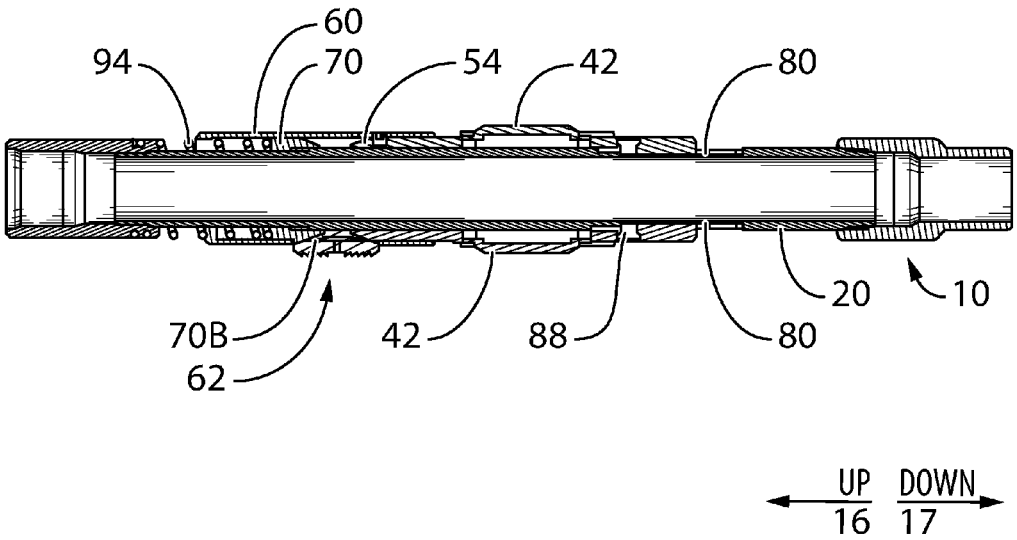
FIG. 5 is a cross-sectional elevation view of the tubing anchor catcher of FIG. 1*a;*
Figure 6:
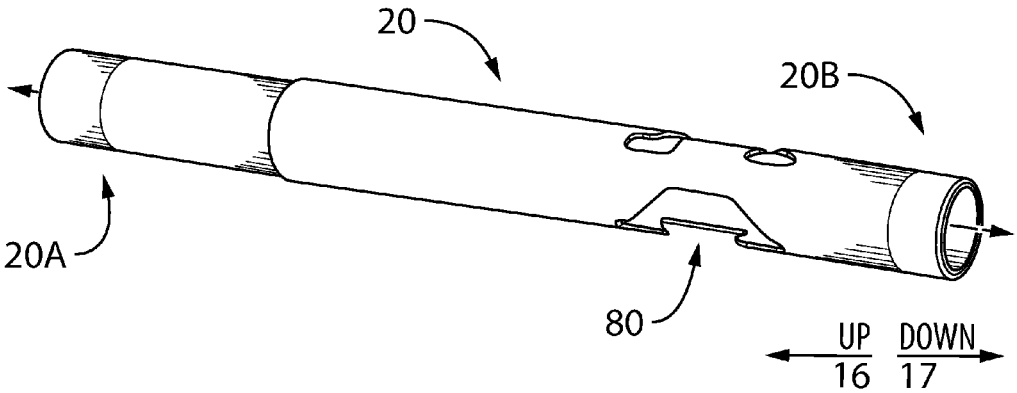
FIG. 6 is a perspective view of a mandrel of the tubing anchor catcher of FIG. 1*a*, showing the externally facing slot.

FIG. 5 depicts the tubing anchor catcher 10 in the set position with the slip or slips 62 extended outwardly from the slip cage 60 for engaging the inner surface 13 of the well conduit 12. The slip or slips 62 are extended due to the conical surfaces 70, 54 moving underneath the slip or slips 62.

At least one slot 80 is formed on the outer surface of the mandrel 20. The slot 80 is dimensioned (width, depth) to slidingly accommodate a protruding portion of the drive pin 88 that extends therein threaded through a hole 56 in the drag body 40. The tubing anchor catcher 10 may comprise one or more sets of slots 80 and drive pins 88. For example, the tubing anchor catcher 10 may have three or four sets of slots 80 and three or four sets of associated drive pins 88 that are generally evenly radially spaced about the mandrel 20.

The operation of the tubing anchor catcher may now be described with reference to FIGS. 1 to 6. To move the mandrel 20 and slot 80 relative to the drive pin 88 to set the anchor catcher, the tubing string can be manipulated at surface between the run-in position and a set position. Due to the drag blocks 42 frictionally engaging the inner surface 13 of the well conduit 12, the drag body 40 and the slip cage 60 remain relatively fixed as the mandrel 20 and the rest of the tubing string are manipulated from surface.

As mandrel 20 pulled, in direction 16, the mandrel 20 slides relative to the drive pin 88. Thereafter, the mandrel 20 can be lowered and turned, for example, a quarter turn (i.e. about 90 degrees). This motion of the tubing string and, therefore, the mandrel 20 causes at least the conical surface 70 to move under the slip or slips 62 and the tubing anchor catcher 10 is set with the slip or slips 62 extending outwards from the slip cage 60 to engage the inner surface 13 of the well conduit 12. The turning is about the longitudinal axis of the tubing string and, therefore, the tubing anchor catcher 10. This manipulation causes the mandrel 20 to move and repositions the drive pin 88 in the slot 80.

Since the quarter turn tubing anchor catcher is a quarter turn tool, the turning of the tubing string to rotate the mandrel 20 is minimal, thereby ensuring that cable 100 held above and below the tool is not significantly urged to deform or slidingly or otherwise move in axial groove 98 and further is not urged to move out of the axial groove 98. Furthermore, since cable 100 is housed in axial groove 98 and outside the tool, the chance of the cable 100 being caught in the slip or slips 62 or drag blocks 42 is eliminated.

To release the slip or slips 62, the tubing string and therefore the mandrel 20 can be manipulated at surface. For example, the mandrel 20 can be pulled up and turned, for example, a quarter turn to cause the mandrel 20 to move so that the conical surface 54 moves out from under the slip or slips 62 and the spring 76 will cause the slip or slips 62 to retract back into the slip cage 60.

When the tubing anchor catcher 10 is in the set position and in the event of a break in the tubing string, etc., which may cause the tubing string to fall down into the well (i.e., in direction 17), the tension in the tubing string is lost. This causes the weight of the tubing string to bear on the biasing member 94. The biasing member 94 will compress from the weight of the tubing string above, and act against the upper cone 70. This action causes the downwardly gripping upper teeth 63A to more directly engage and bite into the inner surface 13 of the well conduit 12 and hold the weight of the tubing string above the tubing anchor catcher 10, for example, until such time that the tubing string can be recovered at surface.

An alternate means of un-setting the tubing anchor catcher 10 is now described. If it is not possible to relocate drive pin 88 in a location in the slot 80 so as to unset slip or slips 62, for example due to packing of sand or other materials into the slot 80, the slip or slips 62 may be unset by applying a sufficient upward tension on the tubing string and the mandrel 20. In one embodiment, the upward tension is of sufficient amplitude to shear the drive pins 88, which form the primary connection between the drag body 40 and the mandrel 20. Then the mandrel 20 may then move upward (i.e. in the direction of arrow 16), relative to the drag body 40, which causes upper cone 70 to move up and out from under the slip or slips 62, which then allows slip or slips 62 to move inwardly as they move away from the second conical surface 54 of the drag body 40. This allows the slip or slips 62 to retract from contacting the inner surface of the well conduit.

FIGS. 7 and 8 depict an alternative or second embodiment of a tubing anchor catcher 100 with an upper end 100A and a lower end 1006. The tubing anchor catcher 100 may comprise many of the same features as tubing anchor catcher 10. For example, one difference between the two tubing anchor catchers 10, 100 is that the drive pin 88 of the tubing anchor catcher 10 may be sheared as a secondary release mechanism, as described above. In contrast, the tubing anchor catcher 100 may comprise a drive pin or drive pins 188 that are not designed to shear as a secondary release mechanism. The lower cone 41 is formed as a separate piece to the drag body 40. The tubing anchor catcher 100 may comprise one or more shear pins 72 that connect the lower end of the lower cone 41 to drag body 40. The shear pins 72 are made of a material that will shear in response to a lower shearing force than the shear force required to shear the pin 188. In this embodiment, the second conical surface 54 is formed on an upper end of the lower cone 41 (see FIG. 12). Lower cone 41 slidably mounts about the external surface of the mandrel 20 so that conical surface 54 in combination with conical surface 70B on cone 70 compress together along mandrel 20 to force the slip or slips 62 into the set position, as described above. The shear pins 72 provide a secondary release of slip or slips 62 by the application of a sufficient pulling force to the tubing string so as to shear the shear pins 72. When the shear pins 72 are sheared, the lower cone 41 is released from connection with the stationary drag body 40 and can move downwardly away from its position under the slip or slips 62. The slip or slips 62 can then retract away from the inner surface 13 of the well conduit 12.

An inventive tubing anchoring tool that is a quarter turn tubing anchor which comprises a linear groove will now be described.

Figure 9:
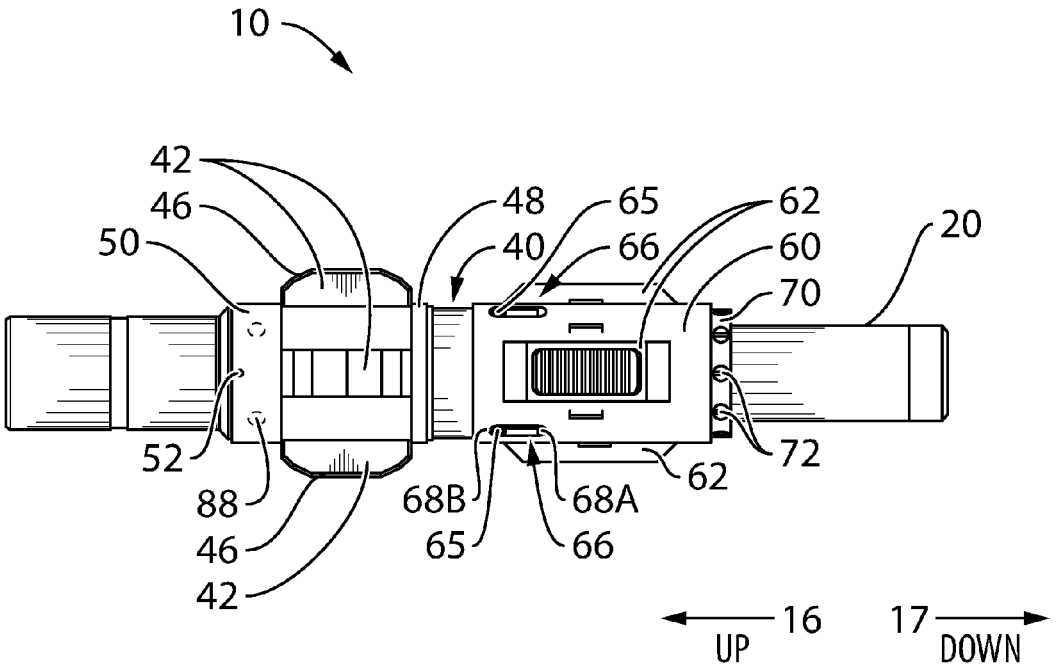
FIG. 9 is a side view of a quarter turn tension tubing anchor which can incorporate an axial groove of the present invention.
Figure 10:
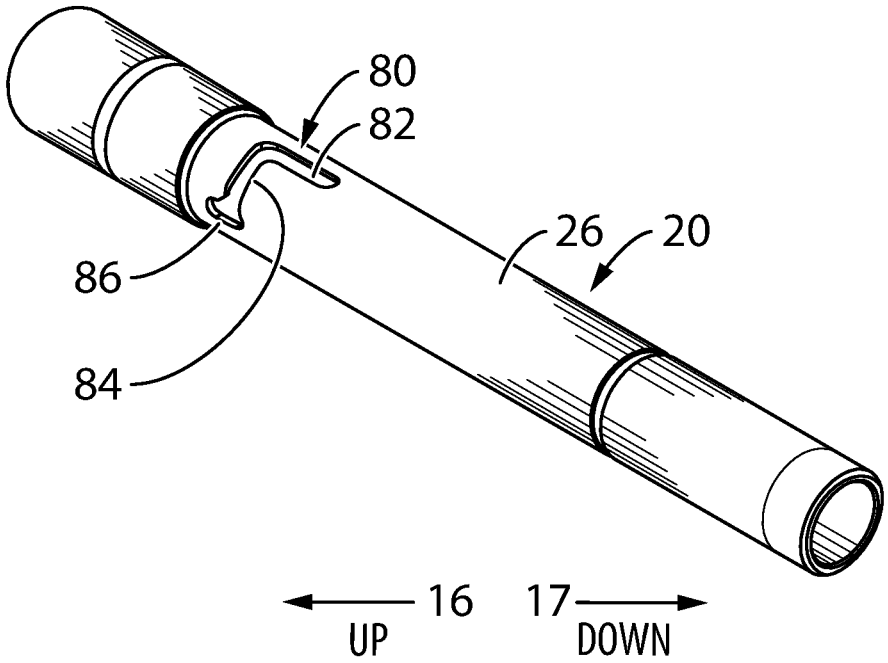
FIG. 10 is a perspective view of a mandrel of the tubing anchor of FIG. 7, showing the externally facing slot.

The quarter turn tension tubing anchor of the example of FIGS. 9 and 10 has a tubular drag body 40 mounted over the mandrel 20 to house a drag means in the form of multiple drag springs or drag blocks 42. Each drag block 42 has a drag block spring 44 or a plurality of drag block springs 44 to bias the outer surface 46 of the drag blocks 42 against the well conduit's inner wall 13. This in turn spaces the tubing anchor away from the inner wall 13 of the well conduit 12 and urges the drag body to remain stationary relative to the mandrel as the tension tubing anchor is run in or otherwise moved within the inner wall of the well conduit. Upper and lower drag body retaining rings 50, 48 keep the drag blocks 42 removably mounted within the drag body 40. Cap screws 52 attach the upper drag body retaining ring 50 to the drag body 40.

A tubular slip cage 60, mounted on the mandrel 20 below the drag body 40 houses a single movable slip 62 or a plurality of movable slips 62. Each slip 62 has an outer surface 63 with teeth for gripping the conduit wall 13 upon contact, and an inner surface.

The drag body 40 and the slip cage 60 can both include one or more grooves 98 extending axially along their outer surfaces to accommodate cables to be carried down hole. Grooves 98 can be present between the drag blocks 42 and slips 62.

The axial groove 98 allows the cable 100 to sit flush with the outermost surface of the anchor, with little or no radial protrusion towards the well conduit, to ensure that it does not catch in any surface of the wellbore.

Furthermore, the axial groove 98 in the present tension tubing anchor allows for placing the cable 100 approximately between the drag blocks 42 which provides an assurance that the cable 100 will not get caught against a drag block 42 when the drag blocks 42 engage with an inside diameter of the wellbore conduit 12.

Returning to aspects of the quarter turn tubing tension anchor not the groove, to hold the slip cage 60 to the drag body 40, set screws 65 are fastened to the drag body 40 and are located within elongate slots 66 spaced circumferentially about the slip cage 60. The slots 66 with upper and lower shoulders 68*a*, 68*b* permit movement of the slip cage 60 relative to the drag body 40.

The cone element 70 housed within the slip cage 60 is mounted on the mandrel 20 by a plurality of circumferentially spaced fasteners in the form of shear screws or shear pins 72 or any shearable or frangible means of fastening. The edge of the cone 70 opposite the shear pins 72 forms a first conical surface 74 that faces towards the box end of the tension tubing anchor and when the mandrel is moved upwardly, the first conical surface 74 wedges under the slips 62, moving the slips towards the well conduit 12 inner wall 13. Likewise, the edge of the drag body 40 forms a second conical surface 54 facing the first conical surface 74 and in operation in the setting step concurrently wedges under the slips 62 and also moves the slips into a set position. However, the first and second conical surfaces 74, 54 should not actively contact the slips in the unset position. A biaser in the form of a slip spring 76 urges each slip 62 radially inwardly into the slip cage 60 and away from the well conduit 12 in the unset position.

The tension tubing anchor has at least one slot 80 formed in the mandrel's outer cylindrical surface 26, best seen in FIG. 8. The slots 80 are dimensioned (width, depth) to slidingly accommodate the drive pins 88. The arrangement of drive pins 88 connected to the drag body 40 and protruding into the slots 80 provides a means for the mandrel 20 to move relative to the drag body 40 as well as a means for securing the drag body 40 to the mandrel 20 of the tension tubing anchor. In the embodiment shown throughout the figures multiple sets of slots 80 and drive pins 88 are shown generally evenly spaced about the mandrel.

The operation of the tension tubing anchor may now be described with reference to FIGS. 9 and 10. The first step is to initially pull the mandrel upwardly by lifting the tubing string in the direction of arrow 16, then the mandrel 20 is rotated to the right or clockwise when viewed from the box end 22 of mandrel 20 a quarter turn. Next, the mandrel is lifted to set the slips. As the mandrel 20 is pulled uphole, the cone element 70 is also lifted. First conical surface 74 of cone elements 70 wedge beneath and urge slips 62 outwardly. As the cone element's first conical surface 74 moves upwardly towards the box end 22 of the mandrel 20, it moves towards the second conical surface 54 of the drag body 40 such that the conical surfaces come together. The second conical surface 54 also wedges under the slips 62 until the outer surfaces of the slips 62 grip the well conduit 12 inner surface 13 anchoring the tubing anchor to the well conduit 12. The tubing string is pulled in tension and may be kept in tension as long as the set position is desired including by the use of means for maintaining tension at the surface of the well such means being well known to persons of skill in the art.

The tension tubing anchor is released, or unset, by reversing the above described setting procedure. The mandrel 20 and first conical surface 74 of cone element 70 are moved downwardly. As the conical surfaces 54, 74 are moved away from each other a means 76 biasing the slips 62 inwardly cause the slips to relocate in their unset position. This allows the tension tubing anchor to be moved to a different position in the well conduit 12 and be set again, or removed from the well.

It will be understood that while the slot design disclosed above is approximately "J" shaped, any configuration of the slot 80 is within the ambit of the invention providing allows for guiding the mandrel when setting the slips.

An alternate method of unsetting the tension tubing anchor is to pull tension on the tubing string to exert sufficient upward force (above the tubing weight) on the mandrel 20 which will shear the shear pins 72 by exceeding their maximum shear resistance. Once the shear pins 72 are sheared, the cone element 70 becomes detached from the mandrel 20 and is free to move away.

As noted above, the groove may be of any orientation including a linear groove, such groove of any shape or depth, provided that cable may be placed within it, as described preceding, formed as described preceding or in any other fashion available or convenient to persons of skill in the art, in either a quarter turn anchor catcher, a quarter turn tension tubing anchor, or in any tubing anchoring tool is able to be formed efficiently and will provide a resulting slip cage and drag body that is able to withstand the significant forces such components do in actuation and other stages of their use, notwithstanding the groove.

While the above disclosure describes certain examples of the present disclosure, various modifications to the described examples will also be apparent to those skilled in the art.

The scope of the claims should not be limited by the examples provided above; rather, the scope of the claims should be given the broadest interpretation that is consistent with the disclosure as a whole.

The invention claimed is:

1. A tubing anchoring tool connectable to a tubing string and positionable within a well conduit, for preventing movement of a tubing string, comprising:

a. a mandrel connectible within the tubing string or well equipment, the mandrel comprising at least one externally facing slot;

b. a slip cage slidably mountable about the mandrel, the slip cage comprising a slip or slips that are adapted for engaging an inner surface of the well conduit;

c. an upper cone element that is slidably mountable about the mandrel, comprising a first conical surface;

d. a drag body slidably mountable about the mandrel, adjacent the slip cage, the drag body comprising at least one drag member for frictionally engaging an inner surface of the well conduit, at least one drive pin for engaging the externally facing slot, and a second conical surface; and e. one or more axial grooves formed along a length of an outer surface of the drag body and the slip cage for accommodating cable placed therein wherein the tubing anchor catcher is articulatable between a run-in position wherein the slip or slips are retracted into the slip cage and a set position wherein the first and second conical surfaces are moved underneath the slip or slips for extending the slip or slips outward from the slip cage so that the outer surfaces of the slip or slips grip the inner surface of the well conduit and wherein the slot controls movement of the mandrel between the run in position and the set position.

2. The tubing anchoring tool of claim 1, wherein the tubing anchoring tool is a quarter turn tension tubing anchor catcher further comprising:

f. a biasing member slidably mountable about the mandrel adjacent the upper cone element for engaging the upper cone element when the biasing member is compressed.

3. The tubing anchoring tool of claim 1, wherein the tubing anchoring tool is a multi-rotation tubing anchoring tool comprising one or more slips that are set by multiple full rotations of a mandrel of the tool.

4. The tubing anchoring tool of claim 1, wherein the tubing anchoring tool is a quarter turn anchor.

* * * * *